US006540571B1

(12) United States Patent
Tolbert

(10) Patent No.: US 6,540,571 B1
(45) Date of Patent: Apr. 1, 2003

(54) MOTOR SUPPORT BRACKET

(75) Inventor: Larry D. Tolbert, Archer, FL (US)

(73) Assignee: University of Florida, Gainesville, FL (US)

( * ) Notice: Subject to any disclaimer, the term of this patent is extended or adjusted under 35 U.S.C. 154(b) by 0 days.

(21) Appl. No.: 09/909,245

(22) Filed: Jul. 19, 2001

(51) Int. Cl.[7] ..... B63H 5/125
(52) U.S. Cl. ..... 440/53
(58) Field of Search ..... 440/53, 55, 61–63, 440/900; 248/640, 643

(56) References Cited

U.S. PATENT DOCUMENTS 1,389,712 A * 9/1921 Thompson et al. ..... 440/53
2,026,481 A * 12/1935 Mathias ..... 440/900
2,748,743 A * 6/1956 Shogran ..... 440/55

* cited by examiner

*Primary Examiner*—Ed Swinehart
(74) *Attorney, Agent, or Firm*—Saliwanchik, Lloyd & Saliwanchik

(57) ABSTRACT

The present invention relates to a device for supporting an outboard motor in a tilted position, relative to the transom of the boat, during transportation by trailer. The outboard motor is affixed to a boat's transom by means of a motor mounting bracket, where the motor support bracket is interposed between the motor mounting bracket and the outboard motor's drive shaft housing.

16 Claims, 8 Drawing Sheets

MOTOR SUPPORT BRACKET

BACKGROUND OF THE INVENTION

1. Field of the Invention

The present invention relates generally to a device for supporting an outboard motor in a tilted position, relative to the transom of the boat, during transportation by trailer. Specifically, the invention relates to a support bracket mounted between the motor mounting bracket and the drive shaft housing, which maintains the motor in a tilted position in order to prevent damage to the motor and the transom during transport.

2. Description of the Related Art

During the transport of a motorboat on a trailer it is necessary to elevate the motor into a tilted position, in order to prevent the lower unit of the outboard motor from being damaged by impact with the ground. Accordingly, many motors have been equipped with mechanical tilting and locking mechanisms, such as hydraulic piston-cylinder assemblies, which are used to support the motor in an elevated position during transport. However, during transport a boat can be subjected to severe jarring due to uneven road surfaces and motion of the vehicle. Such sudden forces, especially in view of the increasing size and weight of outboard motors, can damage and release the locking mechanism, resulting in damage to the boat and motor. Accordingly, devices have been developed which serve to provide additional support to maintain the motor in a tilted position during transport.

One such class of devices is interposed between the motor's drive unit and the trailer, on which the boat is being transported. Such devices are described in U.S. Pat. No. 4,685,888 to Brewer, U.S. Pat. No. 4,828,186 to Weiss, U.S. Pat. No. 4,842,239 to Kinsey, et al, and U.S. Pat. No. 5,021,016 to Currey.

Another such class of devices connects the motor drive unit to the boat's transom. Such devices are described in U.S. Pat. No. 5,031,842 to Mohr and U.S. Pat. No. 5,795,202 to Williams.

A further such class of devices connects the motor drive unit to the motor mounting bracket. Such a device is described in U.S. Pat. No. 5,393,251 to Gilbert.

All patents, patent applications and publications referred to or cited herein, or from which a claim for benefit of priority has been made, are incorporated by reference in their entirety to the extent they are not inconsistent with the explicit teachings of this specification.

BRIEF SUMMARY OF THE INVENTION

The present invention relates to a device for supporting an outboard motor in a tilted position, relative to the transom of the boat, during transportation by trailer. The outboard motor typically comprises a power head, drive shaft housing, and a lower unit to which a propeller is rotateably attached. The outboard motor is affixed to a boat's transom by means of a motor mounting bracket. The motor mounting bracket comprises motor mounting hinges, to which the outboard motor is hingedly affixed, allowing the motor to be tilted. Additionally, the motor mounting bracket further comprises tilt pin holes, which can be used to limit the tilt angle of the motor, wherein a pin is inserted through the aligned pair of tilt pin holes, such that the tilt pin contacts the tilt pin stop, limiting the motor's tilt angle.

The motor support bracket of the subject invention secures the motor in a tilted position for transportation on a trailer. Specifically, the motor support bracket comprises a pair of bracket arms and a motor stop, where the bracket arms are affixed to the motor stop in a parallel arrangement. The bracket arms further comprise a set of aligned attachment holes, wherein each bracket arm comprises at least two attachment holes.

To secure the motor in a tilted position, initially the motor is tilted up. The motor support bracket is then attached to the motor mounting bracket by aligning the motor mounting bracket's tilt pin holes with the motor support bracket's attachment holes. An attachment pin is inserted through the motor mounting bracket's tilt pin holes and the motor support bracket's attachment holes. The motor is then rotated down onto the motor support bracket, wherein the tilt pin stop abuts the motor stop.

These and other features of the present invention will be more readily understood with reference to the following detailed description, read in conjunction with the accompanying drawing figures.

All patents, patent applications and publications referred to or cited herein, or from which a claim for benefit of priority has been made, are incorporated by reference in their entirety to the extent they are not inconsistent with the explicit teachings of this specification, including: U.S. Pat. No. 4,685,888; U.S. Pat. No. 4,828,186; U.S. Pat. No. 4,842,239; U.S. Pat. No. 5,021,016; U.S. Pat. No. 5,031,842; U.S. Pat. No. 5,795,202; and U.S. Pat. No. 5,393,251.

DETAILED DESCRIPTION OF THE INVENTION

Figure 1:
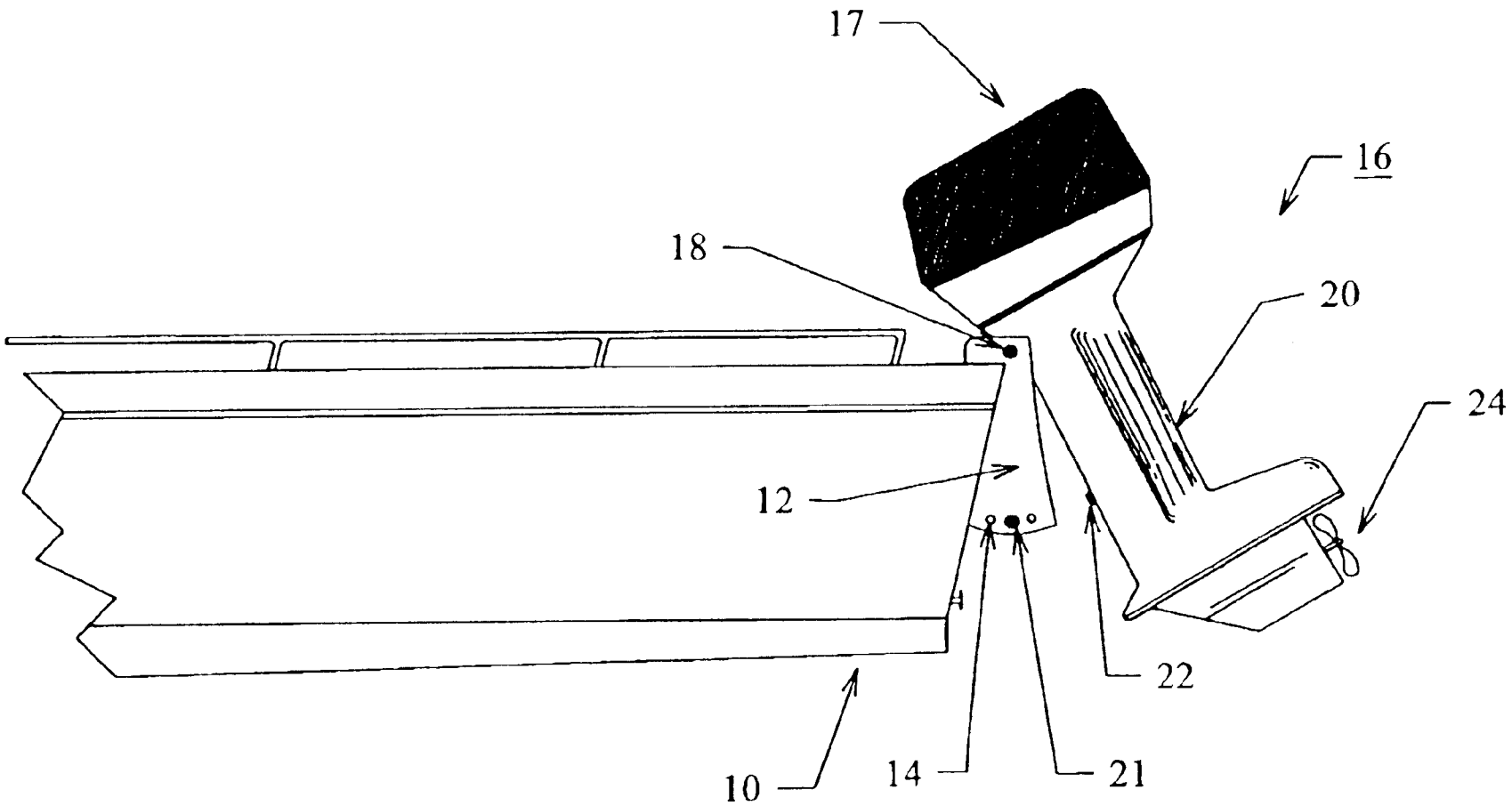
FIG. 1 depicts a side view of a motor mounted on the transom of a boat.
Figure 3:
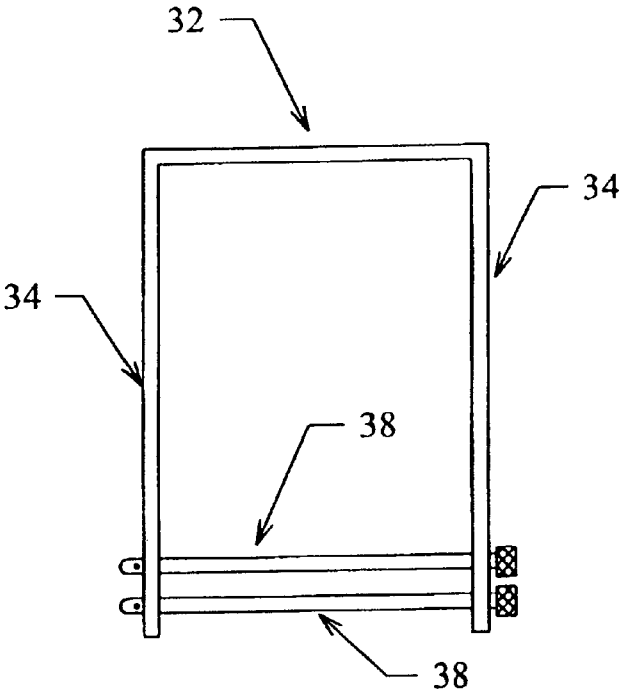
FIG. 3 depicts a top view of the motor support bracket.
Figure 2:
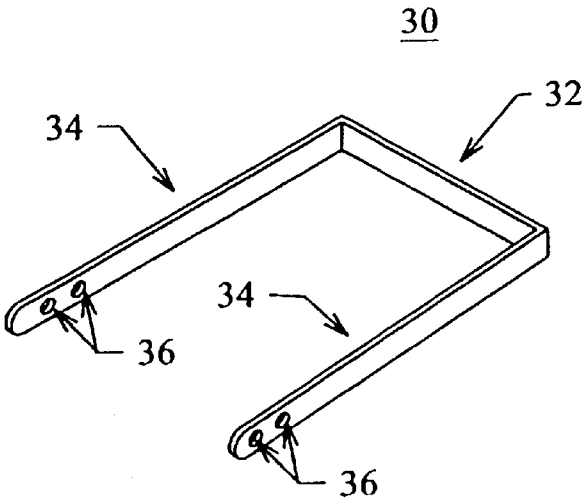
FIG. 2 depicts a perspective view of the motor support bracket.
Figure 4:
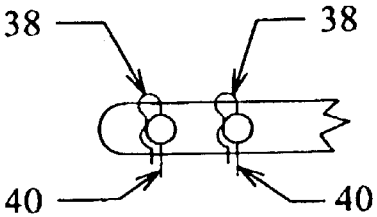
FIG. 4 depicts a side view of the attachment pins.

Referring to FIG. 1, an outboard motor 16 is affixed to a boat's transom 10 by means of a motor mounting bracket 12.

The outboard motor 16 typically comprises a power head 17, drive shaft housing 20, and a lower unit 24 to which a propeller is rotateably attached. The motor mounting bracket 12 comprises motor mounting hinges 18, to which outboard motor 16 is hingedly affixed, allowing the motor 16 to be tilted. Additionally, the motor mounting bracket 12 further comprises aligned tilt pin holes 14 which can be used to limit the tilt angle of the outboard motor 16. In order to limit the tilt angle of the outboard motor 16, a tilt pin 21 is inserted through an aligned pair of tilt pin holes 14, such that the outboard motor 16 is tilted down until the tilt pin 21 contacts the drive shaft housing 20 at the integrated tilt pin stop 22, thus limiting the outboard motor's 16 tilt angle.

Referring now to FIGS. 2–15, the motor support bracket 30 is illustrated. The motor support bracket 30 secures the outboard motor 16 in a tilted position for transportation on a trailer. In one embodiment, the motor support bracket 30 comprises a pair of bracket arms 34 and a motor stop 32, where the bracket arms 34 are arranged parallel to each other and are affixed to the motor stop 32. The motor stop 32 is a rectangular or elliptical shaped plate. Each of the bracket arms 34 comprises a plurality of aligned attachment holes 36. The aligned attachment holes 36 are arranged such that the attachment holes 36 will substantially line-up with the tilt pin holes 14 on the motor mounting bracket 12.

Figure 14:
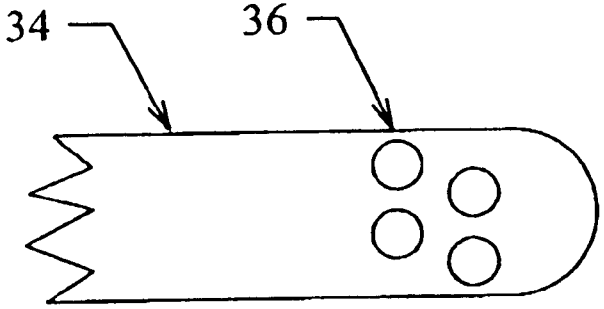
FIG. 14 depicts a perspective view of the motor support bracket comprising an aligned attachment hole pattern for attaching the motor support bracket to low horsepower motor mounting brackets.

In one embodiment, as shown in FIG. 14, the aligned attachment holes 36 are so arranged as to line-up with the tilt pin holes 14 of low horsepower motor mounting brackets 12 and are herein defined as the "low horse power attachment holes."

Figure 15:
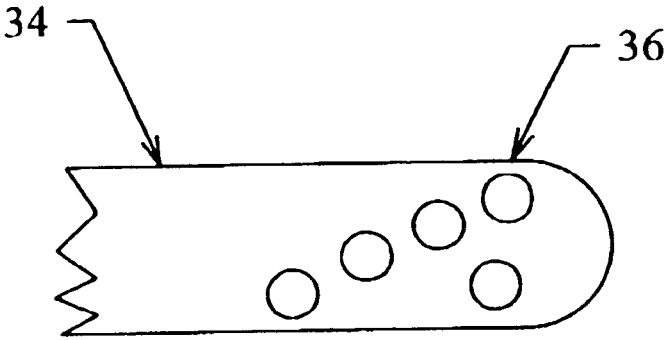
FIG. 15 depicts a perspective view of the motor support bracket comprising an aligned attachment hole pattern for attaching the motor support bracket to large horsepower motor mounting brackets.

In an alternative embodiment, as shown in FIG. 15, the aligned attachment holes 36 are so arranged as to line-up with the tilt pin holes 14 of larger horsepower motor mounting brackets 12, and are herein defined as the "large horse power attachment holes."

Figure 12:
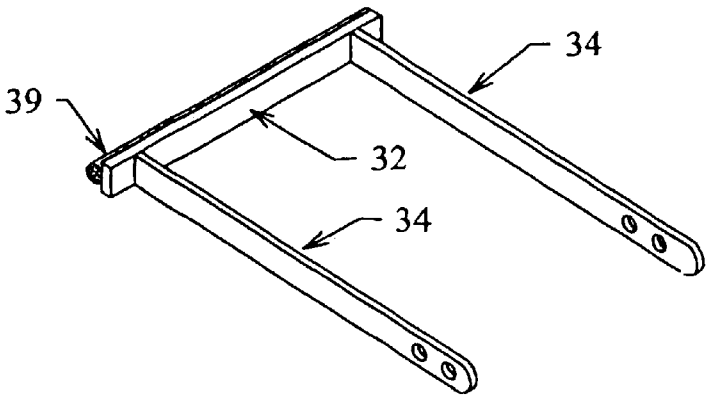
FIG. 12 depicts a perspective view of the motor support bracket with a motor stop comprising a method affixed to a plate.

In an embodiment, the tilt pin stop 22 comprises a motor lock, such that the tilt pin stop 22 secures the outboard motor 16 to tilt pin 21. As shown in FIG. 12, the motor stop 32 comprises is a metal rod 39, where the metal rod is affixed to the front face of the motor stop 32. The tilt pin stop 22 engages the metal rod 39, securing the outboard motor 16 to the motor support bracket 30.

Figure 13:
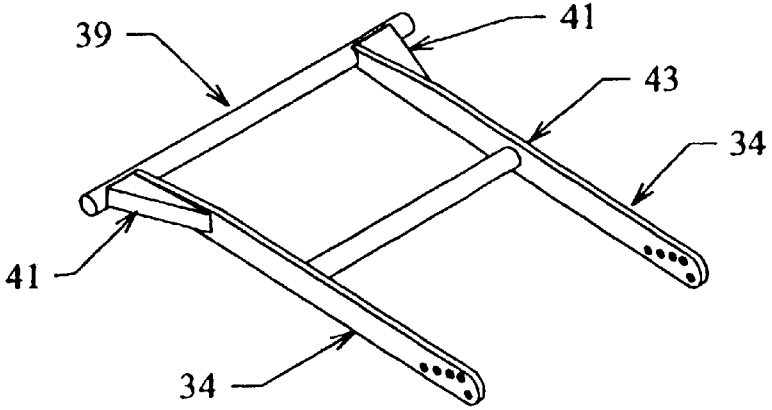
FIG. 13 depicts a perspective view of the motor support bracket with a motor stop comprising a metal rod.

In an alternative embodiment, as shown in FIG. 13, the motor stop 39 is a metal rod affixed to the bracket arms 34 in a parallel arrangement. The motor support bracket 30 can further comprise web support members 41, affixed to the motor stop 39 and the bracket arms 34, for providing additional structural stability.

In an embodiment, the motor support bracket 30 further comprises a rigid spar 43 affixed to the bracket arms 34, for providing additional structural stability.

Figure 5:
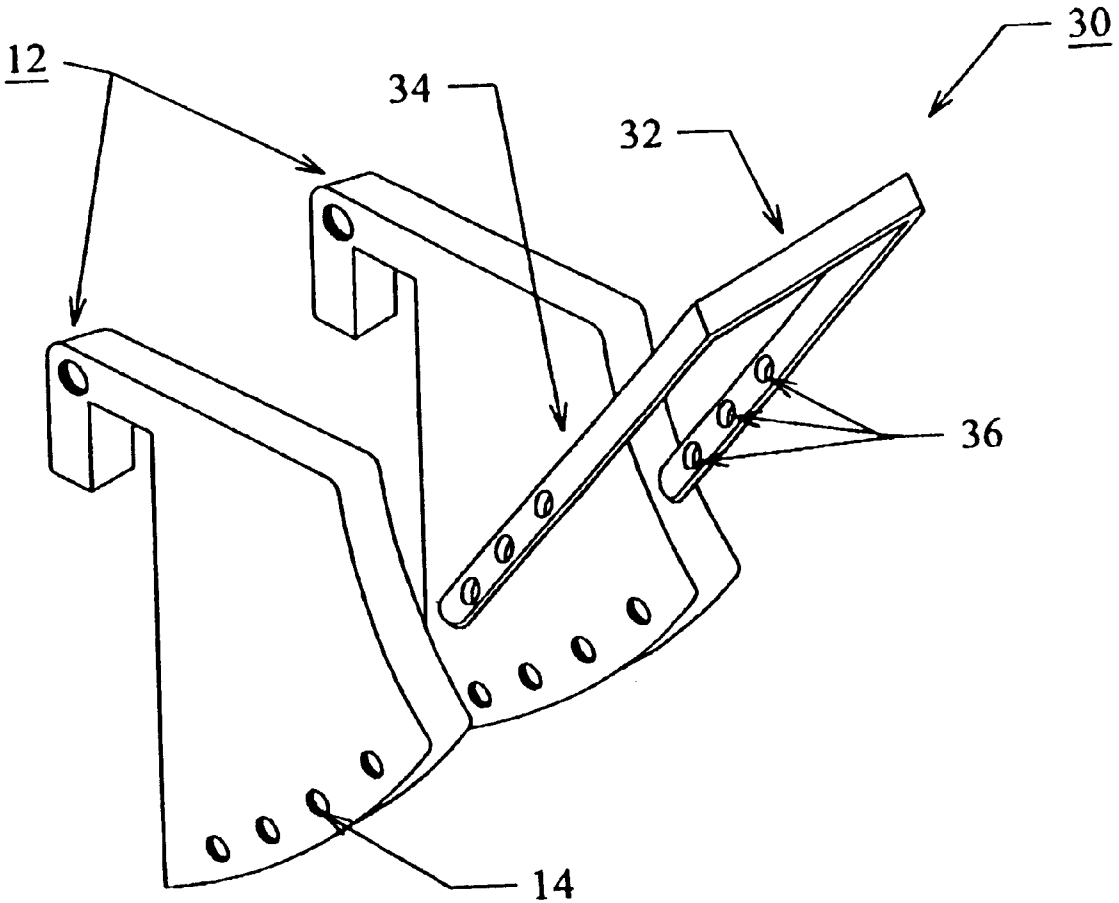
FIG. 5 depicts a perspective view of the motor support bracket and the motor mounting bracket.
Figure 6:
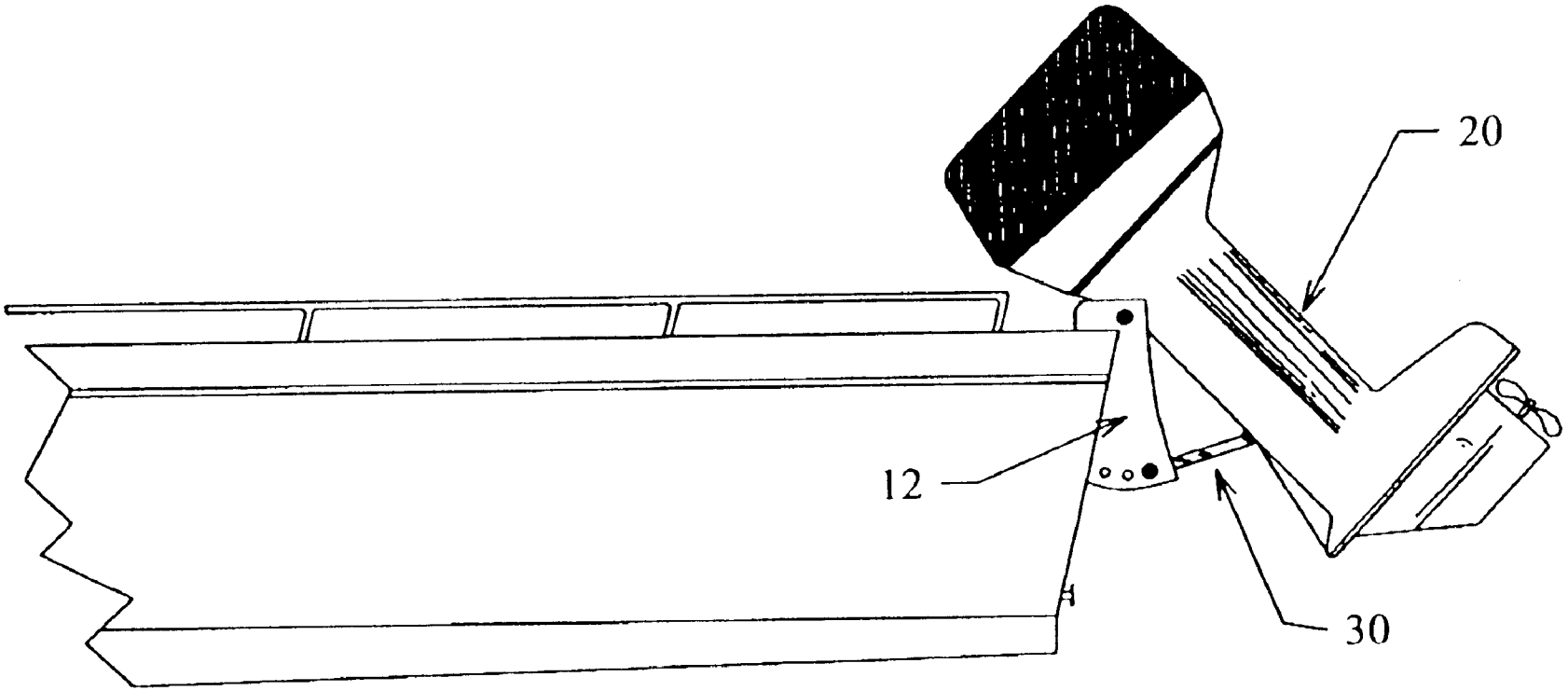
FIG. 6 depicts a side view of the motor support bracket mounted between the motor mounting bracket and the drive unit.

In a method of use, as shown in FIGS. 5–6, the outboard motor 16 is initially tilted up. The motor support bracket 30 is then attached to the motor mounting bracket 12 by aligning the motor mounting bracket's tilt pin holes 14 with the motor support bracket's aligned attachment holes 36. At least one attachment pin 38 is inserted through the tilt pin holes 14 and aligned attachment holes 36, securing the motor support bracket 30 to the motor mounting bracket 12. The attachment pin 38 can be a cotter pin, nut and bolt, metal rod similar to the stock tilt pin, or any similar type of attachment device. The motor 16 is then tilted down onto the motor support bracket 30, such that the tilt pin stop 22 abuts the motor stop 32.

In an embodiment, the bracket arms 34 are attached to the motor mounting bracket 12, such that the bracket arms 34 abut the inner surface of the motor bracket 12.

In an alternative embodiment, the bracket arms 34 are attached to the motor mounting bracket 12, such that the bracket arms 34 abut the outer surface of the motor mounting bracket 12.

Figure 9:
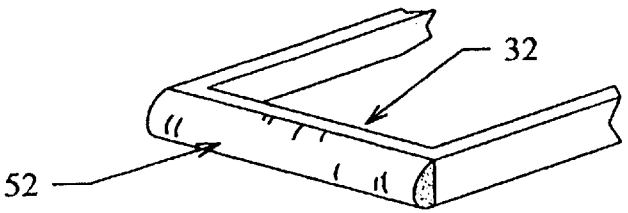
FIG. 9 depicts a perspective view of the motor support bracket with an impact head mounted onto the motor stop.

In a further embodiment, as shown in FIG. 9, the motor support bracket 30 further comprises an impact head 52 mounted onto the motor stop 32. The impact head 52 is attached to the front face of the motor stop 32. The impact head is positioned between the motor stop 32 and the tilt pin stop 22, such that the impact head 52 absorbs the impact any sudden bumps during transport. The impact head 52 can be made of rubber, plastic, or other similar shock absorbing materials.

Figure 10:
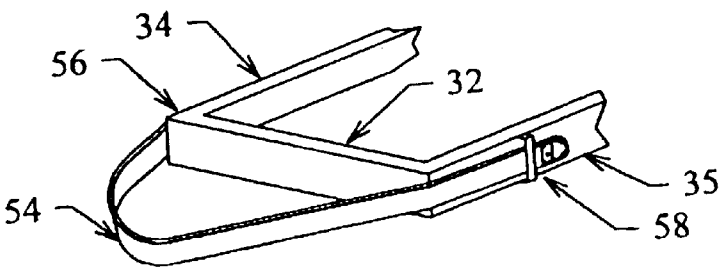
FIG. 10 depicts a perspective view of the motor support bracket with a locking strap.

In a further embodiment, as shown in FIG. 10, the motor support bracket 30 further comprises a locking strap 54. A first end 56 of the locking strap 54 is attached to a first bracket arm 34, in proximity to the motor stop 32. The opposite end 58 of the locking strap 52 is removably attached to the opposing bracket arm 35 by an attachment means. The attachment means can include a buckle, pin, or other similar types of connection devices. In a method of use, the locking strap 52 is fastened around the drive shaft housing 20, securing the drive shaft housing 20 against the motor stop 32.

In an alternative embodiment, the locking strap 52 can be a metal, rubber, bungee cord, rope, nylon, plastic or other similar strap.

Figure 7:
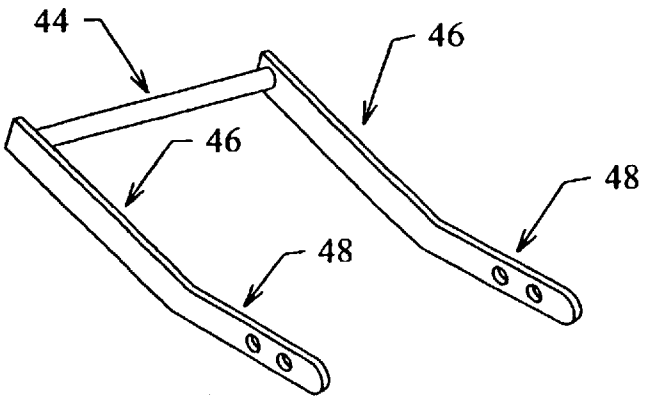
FIG. 7 depicts a perspective view of the motor support bracket with angled bracket arms.

In an alternative embodiment, as shown in FIG. 7, the motor support bracket 30 comprises angled bracket arms 34 comprising an upper arm portion 46 and a lower arm portion 48. The upper arm portion 46 is affixed to the lower arm portion 48 at an angle of about 90° to 180°.

Figure 8:
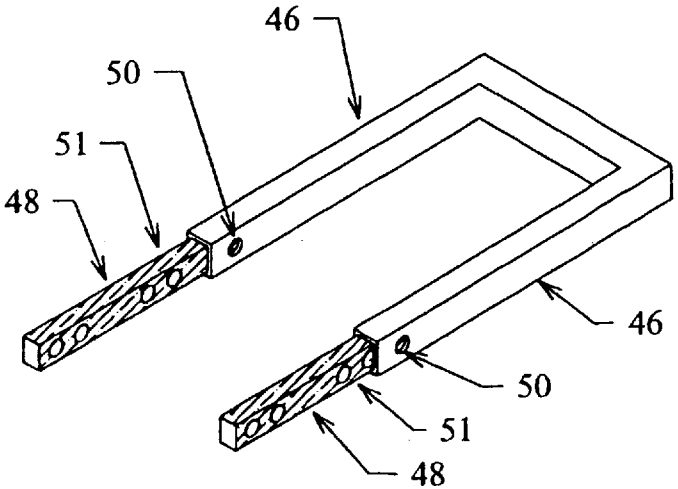
FIG. 8 depicts a perspective view of the motor support bracket with adjustable length bracket arms.

In a further embodiment, the motor support bracket 30 comprises adjustable bracket arms 34. In an embodiment, as shown in FIG. 8, the upper arm portion 46 and lower arm portion 48 of the bracket arms 34 are connected in a sliding arrangement, having an adjustable length.

In an embodiment, the lower arm portion 48 is slideably mounted to the upper arm portion 46, such that the bracket arm's 34 length can be adjusted by sliding the lower arm portion 48 into or out of the upper arm portion 46. When the lower arm portion 48 is adjusted such that the bracket arm 34 has the appropriate length, the lower arm portion 48 is secured to the upper arm portion 46.

Alternatively, the bracket arm's 34 length can be adjusted by sliding the upper arm portion 46 into or out of the lower arm portion 48.

In an embodiment, the lower arm portion 48 comprises a set of adjustment pin holes 49, where the adjustment pin holes 49 are spaced along the lower arm portion 48. The upper arm portion 46 comprises a locking pin hole 47. The bracket arm's 34 length is locked by aligning as adjustment pin hole 49 with the locking pin hole 47 and inserting a locking pin 50.

Figure 11:
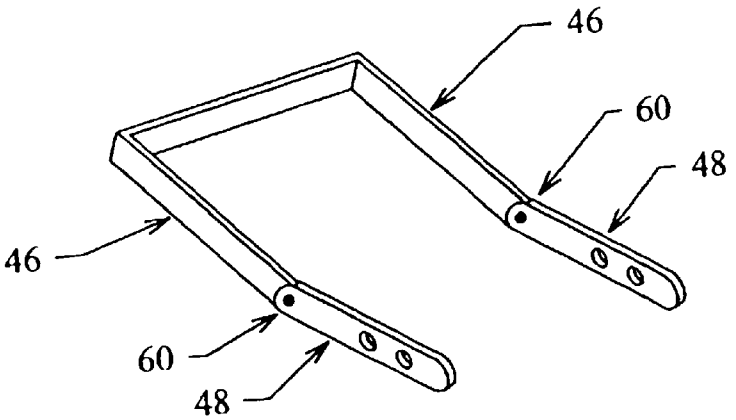
FIG. 11 depicts a perspective view of the motor support bracket with adjustable angled bracket arms.

In an alternative embodiment, as shown in FIG. 11, the attachment angle between the upper arm portion 46 and the lower arm portion 48 is adjustable. The lower arm portion 48 is hingedly attached to the upper arm portion 46, such that the upper arm portion 46 can rotate about the lower arm portion 48.

In a embodiment the hinge 60 connecting the upper arm portion 46 and the lower arm portion is a locking hinge, which can be locked into place once the upper arm portion 46 and the lower arm portion 48 are adjusted to the correct angle.

It should be understood that the examples and embodiments described herein are for illustrative purposes and that various modifications or changes in light thereof will be suggested to persons skilled in the art and are to be included within the spirit and purview of this application and the scope of the appended claims.

I claim:

1. A motor support bracket for securing an outboard motor in a tilted position for transport of a boat on a trailer, the bracket comprising:

a motor stop for contacting a drive shaft housing of the outboard motor to maintain the motor in a tilted position;

a pair of bracket arms, each arm comprising a proximal end and a distal end, wherein said distal ends are affixed to said motor stop such that said bracket arms are in a substantially parallel arrangement, and wherein said proximal ends comprise a plurality of aligned attachment holes; wherein said attachment holes are arranged to substantially line-up with a set of aligned tilt pin holes on a motor mounting bracket; and at least one attachment pin, wherein in operation said attachment pin is inserted through said aligned attachment holes and the aligned tilt pin holes, removably securing said motor support bracket to the motor mounting bracket such that said motor support bracket is interposed between the motor mounting bracket and the outboard motor.

2. The motor support bracket according to claim 1, wherein said motor stop is a plate.

3. The motor support bracket according to claim 2, wherein said motor stop is substantially rectangular or elliptical in shape.

4. The motor support bracket according to claim 2, wherein said motor stop comprises a cylindrical rod affixed to a front face of said plate.

5. The motor support bracket according to claim 2, wherein said motor stop further comprises an impact head affixed to a front face of said plate.

6. The motor support bracket according to claim 1, wherein said motor stop is a cylindrical rod.

7. The motor support bracket according to claim 1, wherein said motor support bracket further comprises a locking strap removably affixed to at least one of said bracket arms, such that in operation said locking strap secures the outboard motor against said motor stop.

8. The motor support bracket according to claim 1, wherein said bracket arms comprise an upper arm portion slideably affixed to a lower arm portion, such that the length of said bracket arms is adjustable.

9. The motor support bracket according to claim 1, wherein said bracket arms comprise an upper arm portion pivotally affixed to a lower arm portion, such that an angle between said upper arm portion and said lower arm portion is adjustable.

10. The motor support bracket according to claim 1, wherein said bracket arms comprise large horsepower attachment holes.

11. The motor support bracket according to claim 1, wherein said bracket arms comprise low horsepower attachment holes.

12. A motor support bracket for securing an outboard motor in a tilted position for transport of a boat on a trailer, the bracket comprising:

a motor stop for contacting a drive shaft housing of the outboard motor to maintain the motor in a tilted position;

a pair of bracket arms, each arm comprising a proximal end and a distal end, wherein said distal ends are affixed to said motor stop such that said bracket arms are in a substantially parallel arrangement, and wherein said proximal ends comprise a plurality of aligned attachment holes, wherein said attachment holes are arranged to substantially line-up with a set of aligned tilt pin holes on a motor mounting bracket;

at least one attachment pin, wherein in operation said attachment pin is inserted through said aligned attachment holes and the aligned tilt pin holes, removably securing said motor support bracket to the motor mounting bracket such that said motor support bracket is interposed between the motor mounting bracket and the outboard motor; and means for securing the drive shaft housing against said motor stop.

13. The motor support bracket according to claim 12, wherein said means for securing the drive shaft housing against said motor stop comprises a locking strap removably affixed to at least one of said bracket arms.

14. A motor support bracket for securing an outboard motor in a tilted position for transport of a boat on a trailer, the bracket comprising:

a motor stop for contacting a drive shaft housing of the outboard motor to maintain the motor in a tilted position;

a pair of bracket arms and a motor stop, each of said bracket arms comprising an upper arm portion and a lower arm portion, wherein said upper arm portions and said lower arm portions are adjustably connected to each other, the distal ends of said upper arm portions being affixed to said motor stop such that said bracket arms are in a substantially parallel arrangement, and the proximal end of each of said lower arm portions comprising a plurality of aligned attachment holes, wherein said attachment holes are arranged to substantially line-up with a set of aligned tilt pin holes on the motor mounting bracket; and at least one attachment pin, wherein in operation said attachment pin is inserted through said aligned attachment holes and the aligned tilt pin holes, removably securing said motor support bracket to the motor mounting bracket such that said motor support bracket is interposed between the motor mounting bracket and the outboard motor.

15. The motor support bracket according to claim 14, wherein said upper arm portions are slideably connected to said lower arm portions, such that each of said bracket arms' lengths are adjustable.

16. The motor support bracket according to claim 14, wherein said upper arm portions are pivotally connected to said lower arm portions, such that an angle between said upper arm portions and said lower arms portion is adjustable.

* * * * *

UNITED STATES PATENT AND TRADEMARK OFFICE

CERTIFICATE OF CORRECTION

PATENT NO. : 6,540,571 B1
DATED : April 1, 2003
INVENTOR(S) : Larry D. Tolbert

It is certified that error appears in the above-identified patent and that said Letters Patent is hereby corrected as shown below:

Column 2,
Line 51, "comprising a method affixed to a" should read -- comprising a metal rod affixed to a --.

Column 5,
Line 2, "illustrative purposes and that" should read -- illustrative purposes only and that --.

Signed and Sealed this

Second Day of September, 2003

JAMES E. ROGAN
*Director of the United States Patent and Trademark Office*